United States Patent [19]

Poulton

[11] Patent Number: 4,946,071

[45] Date of Patent: Aug. 7, 1990

[54] MATERIALS HANDLING EQUIPMENT

[75] Inventor: Barrie Poulton, Cheltenham, England

[73] Assignee: Flomat Limited, Derbyshire, England

[21] Appl. No.: 330,864

[22] Filed: Mar. 17, 1989

[51] Int. Cl.[5] ..... B65D 33/00

[52] U.S. Cl. ..... 222/105; 222/181; 222/185; 141/314; 141/371

[58] Field of Search ..... 222/94, 105, 107, 181, 222/185, 525, 542; 141/114, 312–314, 371, 372

[56] References Cited

U.S. PATENT DOCUMENTS

| | | | |
|---|---|---|---|
| 3,433,400 | 3/1969 | Hawkins | 222/185 |
| 3,742,989 | 7/1973 | Campbell et al. | 141/371 |
| 4,056,132 | 11/1977 | DeCrane | 141/314 |
| 4,182,386 | 1/1980 | Alack | 141/314 |
| 4,241,769 | 12/1980 | Wiesner | 141/314 |
| 4,247,021 | 1/1981 | Renier et al. | 222/185 |
| 4,676,284 | 6/1987 | DeCrane | 141/314 |

*Primary Examiner*—Kevin P. Shaver
*Assistant Examiner*—Steven Reiss
*Attorney, Agent, or Firm*—Charles J. Brown

[57] ABSTRACT

There is disclosed equipment for discharging material from an intermediate bulk container having a liner provided with a discharge spout located within an outer bag and comprising a discharge duck and apparatus for sealably connecting the lower end of the spout with the upper end of the duct. Preferably the spout is arranged with an upturned cuff which is clamped between the mouth of the duct and a moveable clamping apparatus.

3 Claims, 3 Drawing Sheets

MATERIALS HANDLING EQUIPMENT

This invention concerns materials handling equipment and more particularly equipment for discharging particulate solid materials from intermediate bulk containers of the kind (hereinafter termed containers of the kind referred to) comprising an outer bag and an inner liner having a normally tied tubular spout through which discharge can be effected after the spout has been untied.

Containers of the kind referred to are particularly suited to carriage of foodstuffs and pharmaceuticals which must be protected from contamination.

The inner liner serves many purposes. The outer bag can be used many times without risk of contamination by inserting a replacement liner each time the bag is used. The inner liner prevents egress of very fine powders through the weave or seams of the outer bag. The liner prevents ingress of water to the product during transport of the bag and gives some measure of protection to the product if the outer bag should become damaged.

One frequently encountered problem is the presence of foreign matter between the bag and inner liner which can be discharged with the contents of the liner with the risk of contaminating the product.

It is an object of the present invention to provide equipment for discharging a container of the kind referred to which overcomes the difficulty aforesaid.

According to the present invention there is provided equipment for discharging a container of the kind referred to comprising means for supporting the bag over a discharge duct and means for sealably connecting the lower end of the tubular spout with said discharge duct.

The discharge duct may be fixed and have an open upper end over which the lower end of the tubular spout of the container may be arranged and there may be moveable means for clamping the lower end of said spout against the upper end of the duct.

The means for clamping the lower end of the tubular spout may comprise an annular member moveable between a raised position spaced from the upper end of said duct and a lowered position engaging said duct.

The clamping means may be moveable by pneumatic actuating cylinder means.

The invention will be further apparent from the following description with reference to the several figures of the accompanying drawings which show, by way of example only, one form of discharge equipment embodying same.

Figure 1:
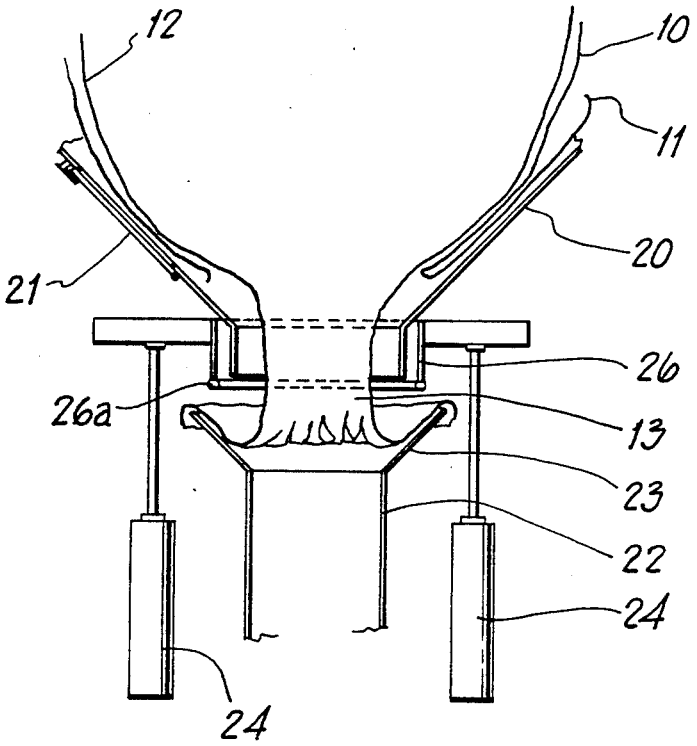

Of the drawings:

FIG. 1 shows a vertical cross-section through the equipment;

and FIGS. 2–5 show stages in the discharge of the contents of the container using the equipment of FIG. 1.

Referring now to the drawings it will be seen that the container comprises an outer bag 10 of woven polypropylene having a flap 11 closing its underside and an inner liner 12 of polyethylene having a tubular discharge spout 13 on its underside.

Turning now to FIG. 1, the discharge equipment comprises a shallow hopper 20 adapted to receive the lower end of the container. A door 21 gives access to the interior of the hopper to enable the spout of the liner to be untied.

Beneath the hopper 20 is a fixed discharge duct 22 having a frusto-conical mouth 23 at its upper end.

Reciprocable in a vertical direction above the mouth 23 under the control of pneumatic actuating cylinders 24 is an annular spout section 26 of cylindrical form having a circular resilient seal on its lower edge and which in its lowered position sealingly engages the internal upwardly directed surface of the mouth 23.

Means (not shown) may be provided for vibrating the hopper 20.

Figure 2:
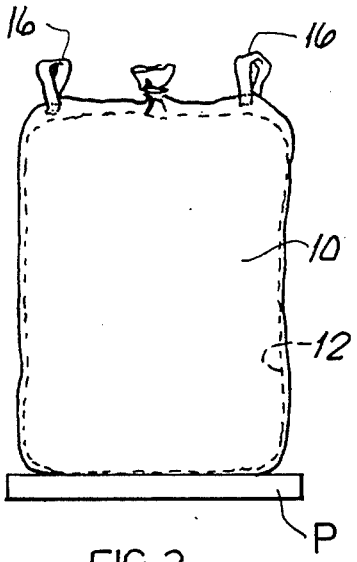
Figure 3:
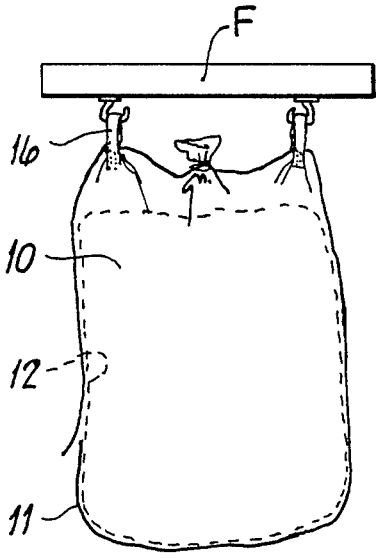
Figure 5:
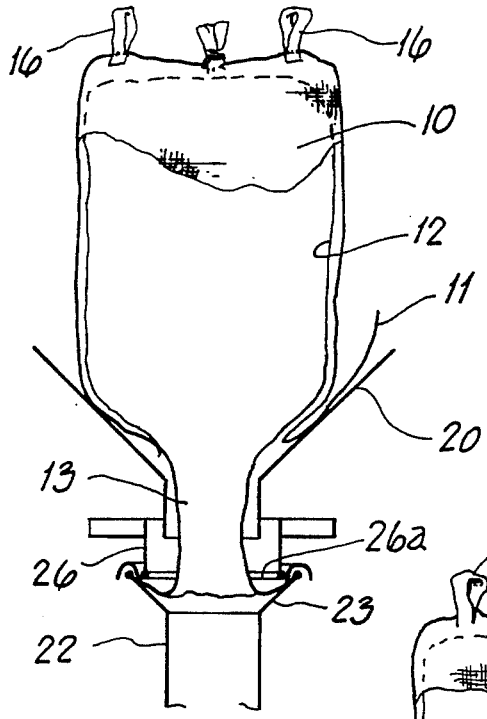
Figure 4:
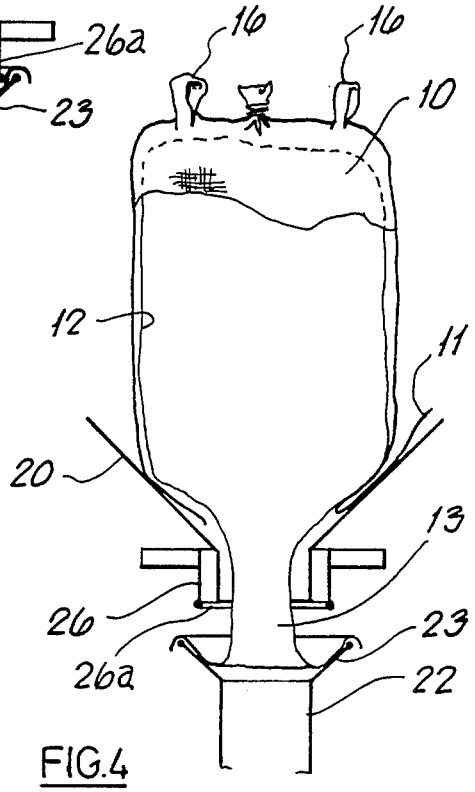

In use, a container is delivered to the vicinity of the discharge equipment on a pallet P (FIG. 2). The container is suspended by loops 16 from a rigging frame F and raised using a fork-lift truck to enable the flap 11 to be pulled aside (FIG. 3). The container is lowered onto the hopper 20, and the spout 13 is untied and pulled down and arranged with an upturned cuff over the mouth 23 (FIG. 4). The spout section 26 is lowered to clamp the spout 13 against the mouth 23 with the cuff between the two relatively moveable parts (FIG. 5). Discharge is then effected, assisted if necessary by vibrating hopper 20. entered the duct 21, will be retained in the upturned cuff at the lower end of spout 13.

After raising spout section 26 the spout 13 can be removed from mouth 23 without spilling any retained material into duct 22.

It will be appreciated that it is not intended to limit the invention to the above example only, many variations, such as might readily occur to one skilled in the art, being possible, without departing from the scope thereof as defined by the appended claims.

I claim:

1. Equipment for discharging a container comprising
(a) means for supporting a bag over a discharge duct;
(b) said discharge duct being fixed and having an open frusto conical mouth at its upper end;
(c) means for sealably connecting a lower end of a tubular spout over the open mouth of the discharge duct; and
(d) movable means for clamping the lower end of the spout against the upper end of the duct comprising
(i) an annular member of cylindrical form moveable between a raised position spaced from the upper end of the duct and a lower position engaging the duct, and
(ii) an upturned cuff on the tubular spout which may be clamped between the conical surfaces of the mouth and annular member.

2. Equipment according to claim 1 wherein the lower circular edge of the annular member is provided with a resilient seal.

3. Equipment according to any one of claims 1 or 2 wherein the clamping means is moveable by pneumatic actuating cylinder means.

* * * * *